United States Patent [19]

Gajjar

[11] Patent Number: 5,029,457

[45] Date of Patent: Jul. 9, 1991

[54] METHOD OF WARP KNITTING

[75] Inventor: Bahrat J. Gajjar, Wilmington, Del.

[73] Assignee: E. I. Du Pont de Nemours and Company, Wilmington, Del.

[21] Appl. No.: 530,352

[22] Filed: May 30, 1990

Related U.S. Application Data

[63] Continuation-in-part of Ser. No. 397,178, Aug. 22, 1989, abandoned.

[51] Int. Cl.[5] ..... D04B 21/14

[52] U.S. Cl. ..... 66/195

[58] Field of Search ..... 66/195

[56] References Cited

U.S. PATENT DOCUMENTS

| | | | |
|---|---|---|---|
| 3,442,099 | 5/1969 | Auville et al. | 66/86 |
| 3,494,150 | 2/1970 | Grau | 66/86 |
| 3,552,154 | 1/1971 | Lesley | 66/192 |
| 3,910,075 | 10/1975 | Holliday | 66/192 |
| 3,931,721 | 1/1976 | Adamson | 66/195 |
| 4,307,587 | 12/1981 | Baegen et al. | 66/195 |
| 4,638,648 | 1/1987 | Gajjar | 66/193 |
| 4,649,722 | 3/1987 | Gajjar | 66/195 |
| 4,667,490 | 5/1987 | Patel | 66/195 |
| 4,688,403 | 8/1987 | Gajjar | 66/195 |
| 4,802,346 | 2/1989 | Gajjar | 66/195 |

FOREIGN PATENT DOCUMENTS

| | | | |
|---|---|---|---|
| 61-119757 | 6/1987 | Japan . | |
| 3203853 | 8/1988 | Japan | 66/195 |
| 0735686 | 5/1980 | U.S.S.R. | 66/195 |
| 1008302 | 3/1983 | U.S.S.R. | 66/195 |

*Primary Examiner*—Werner H. Schroeder
*Assistant Examiner*—John J. Calvert

[57] ABSTRACT

Wrap knit fabric having a two and three-course repeat pattern of alternating first and second, or first, second and third and first, second, third and fourth bar yarns. The fabric is prepared by interlocking the first and second or first, second and third bar yarns using a combination of knit and laid-in stitches in the same for two course, and same and opposite fashion for three and four course repeat.

4 Claims, 10 Drawing Sheets

TWO COURSE INTERLOCKING

THREE COURSE INTERLOCKING

1st BAR
2nd BAR 0 1 2 3 4 5

1st BAR
2nd BAR
3rd BAR 0 1 2 3 4 5 0 1 2 3 4 5 0 1 2 3 4 5

METHOD OF WARP KNITTING

This is a continuation-in-part of application Ser. No. 07/397,178 filed Aug. 22, 1989, abandoned Nov. 28, 1990.

BACKGROUND OF THE INVENTION

This invention relates to the warp knitted fabrics and, more particularly, to a method of knitting the fabrics wherein two course repeat, first and second bar yarns will appear on the loop side or technical face of the fabric, and in three course repeat, all three, first, second and third, bar yarns will appear on the loop side. In the case of four course repeat, four yarns will appear on the loop side. However, in all three cases only the front bar yarn will appear on the float or technical back of the fabric.

Spun yarn can be knitted on the warp knitting machine, but it is difficult to knit it at high speeds, and even at lower knitting speeds the knit performance of the spun yarn is very poor (1000–2000 racks/end out for the filament yarn out vs. 100 racks/end out for spun yarn). When spun yarn is knitting, it could break but when it is laid-in, it does not involve knitting and thus it does not break. Also, when the spun yarn is replaced with filament yarn, the knitting improves as the filament yarn knits much better. In conventional knitting in a six course repeat the spun yarn is knitting all 6 stitches (one stitch per course). In U.S. Pat. No. 4,802,346 in the same 6 stitches only three stitches are knitting with spun yarn and in the instant invention only two stitches are knitted with spun yarn.

SUMMARY OF THE INVENTION

This invention provides a method of preparing fabric of yarn with improved knitting performance while improving the uniformity of the fabric as yarns from two bars are blending on the fabric surface. The method involves operating the front or first guide bar of a warp knitting machine in repeating patterns of alternating laid-in and knit for two course repeat while operating the second or back guide bar in repeating stitch pattern that is in the same direction to the stitch pattern of the first guide bar. So when the first guide bar threads are laid in, the second guide bar threads are knit-in and subsequently repeating both stitch patterns to interlock along the fabric.

For three course repeat the method involves operating the front or first guide bar of a warp knitting machine in repeating patterns of laid-in stitches twice and knit-in stitches once. The middle bar uses laid-in, knit-in and laid-in stitches at the same time. The back or third bar repeat knit-in stitches once and laid-in stitches twice. In other words, when one bar is knitting in, other bars are laying in and in a three bar fabric in knitting three courses a guide bar knits only once. All three bars could go in the same direction or they could go in opposite directions.

The method may also include the additional step of operating a third bar for two course repeat, and for three course repeat it could use the fourth bar in conjunction with the first and second or first and third guide bar in knit-in or laid-in stitch patterns. The yarn used with this method may be untextured continuous filament yarn, textured yarn, spun yarn, or these in combination with elastomeric yarns.

The two course repeat fabrics when knitted with 100% hard smooth yarn like 40–13 nylon runs or splits but three bar three course fabric or four bar four course repeat fabrics have better stability or run resistance.

DETAILED DESCRIPTION OF THE ILLUSTRATED EMBODIMENTS

The invention is best defined in terms of stitch patterns as shown in FIGS. 1 to 44 for warp knit fabrics with two, three and four sets of threads. One could use non-elastomeric yarns in these stitch constructions and/or by adding one extra bar with elastomeric yarn in the back. This last bar could use any one of the same type of stitches or 1-2, 1-0 or 1-0, 1-2 with open (2-1, 0-1) or closed (1-2, 1-0) or mix (2-1, 1-0) or three needle float (2-3, 1-0) or combination of knit and lay (e.g. 1-2, 0-0) or laid-in stitches (e.g. 1-1, 0-0, 2-2, 0-0), etc.

For each of the figures represented a single needle-bar is employed, which is fed from a front or first bar and one or more second, third or back guide bars. Knitting needle positions for each of a plurality of successive courses are represented in the diagrams by horizontal lines or dots, the top line representing the course formed immediately after the course represented by the bottom line. One first or front-bar end and two or more other bar ends are shown in each instance, it being understood that one end of each is knitted on each knitting needle for every course. More particularly, referring to FIG. 1 the stitch construction of the fabric is notationally set out and shows that the threads of the first or front bar, one of which is indicated at 60, have back-and-forth movement to nonadjacent needles in successive courses as indicated by the numbers 2-3, 0-0 and that the threads of the second 61 have similar movements as indicated by the numbers 3-3, 1-0, respectively.

The fabric is preferably made according to the invention on a tricot or similar warp knitting machine employing a single needle bar and at least three guide bars respectively known as the back, middle and front guide bars. The needle bar is provided with knitting needles which may vary in number according to the gauge of the machine, and each guide bar has a number of yarn guides corresponding to the number of needles of the needle bar. The guide bars are able to be shogged under pattern control a distance of one or more needles in opposite directions lengthwise of the needle bar, and both bars are also swingable transversely of the needle bar to permit their yarn guides to pass between the needles, the combined shogging and swinging movements permitting the yarns to be fed to the needles and to be knit thereby.

Figure 45:
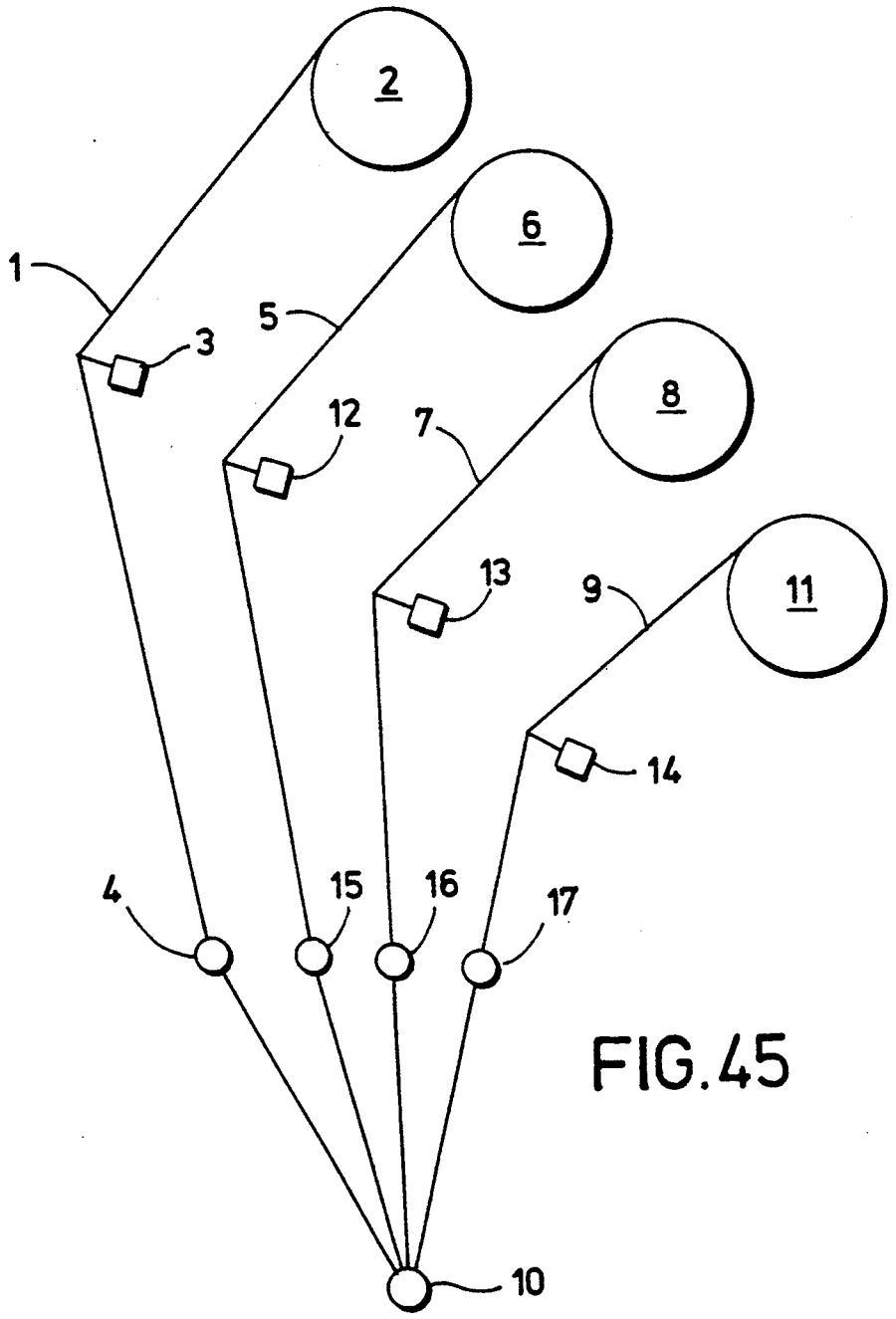
FIG. 45 is a schematic elevation view of the apparatus elements for warp knitting according to the invention.

The schematic illustration for such a warp knitting machine is shown in FIG. 45. The front or first guide bar warp is fed from threads 1 on beam 2. The threads first pass in the usual well-known manner through a fixed reed 3 which serves to keep the threads separated from the reed. Each thread 1 is threaded through its guide in guide bar 4 and onto needle bed 10. The threads 5 from beam 6 and threads 7 from beam 8 and threads 9 from beam 11 are fed through respective fixed reeds 12, 13 and 14 and second, third and fourth guide bars 15, 16 and 17 to needle bed 10. It should be understood that the beams could be split as disclosed in U.S. Pat. No. 4,020,656 and/or fully or partially threaded. The movements of needle through successive courses are indicated below each diagram by their numbers as set forth in Table I.

Figure 1:
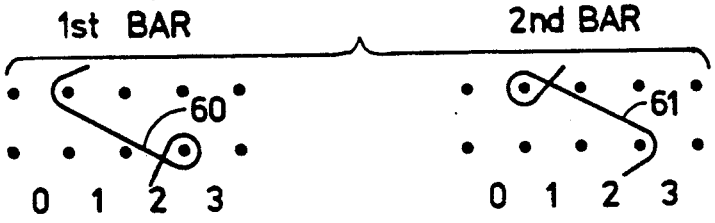
FIGS. 1–44 and 48 are stitch pattern diagrams for the fabrics made according to the invention.

FIG. 1 represents a two course interlocking structure with both the guide bars going in the same direction.

Figure 2:
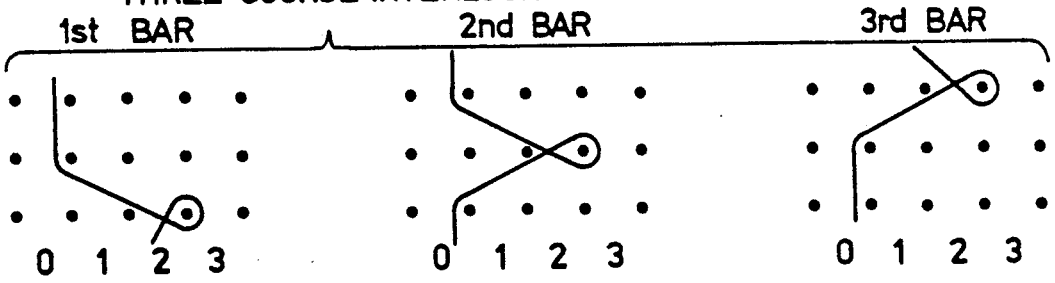
Figure 3:
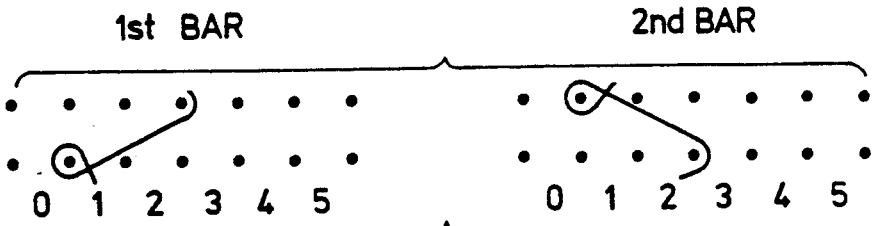
Figure 4:
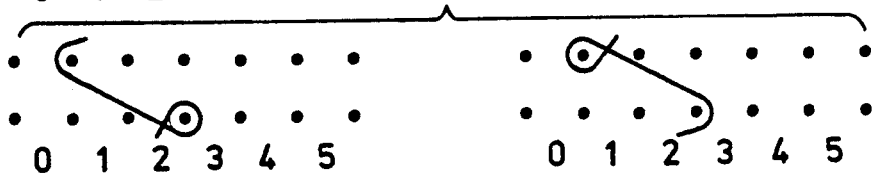
Figure 5:
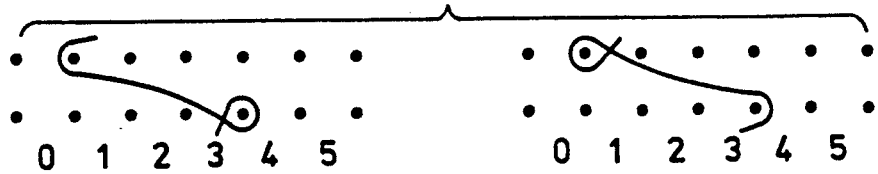
Figure 6:
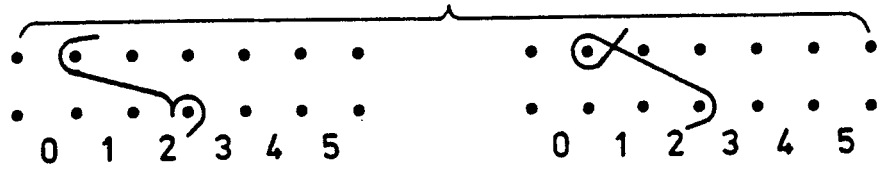
Figures 7, 8, 9, 10, 11, 12, 13, 14, 15:
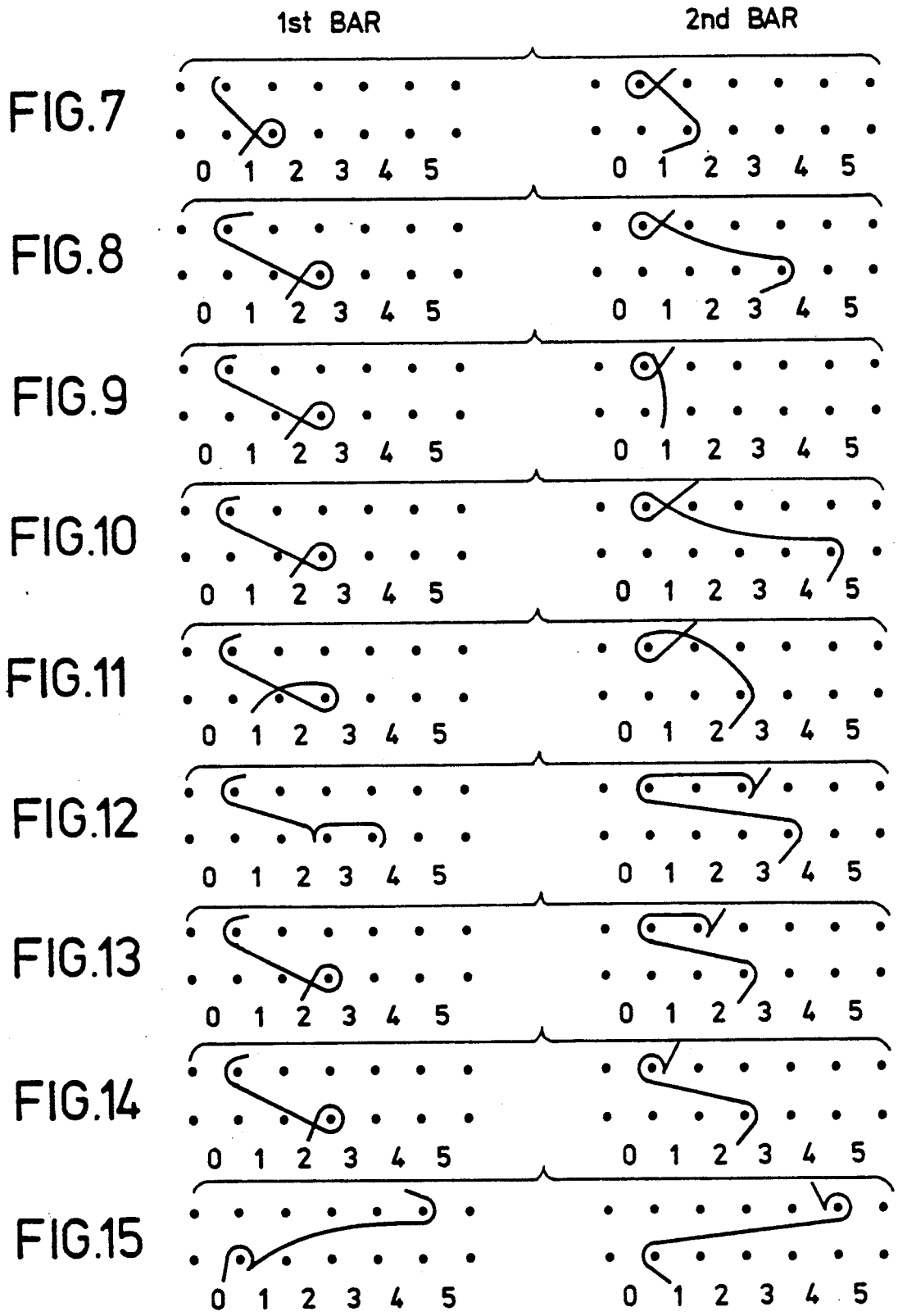
Figure 16:
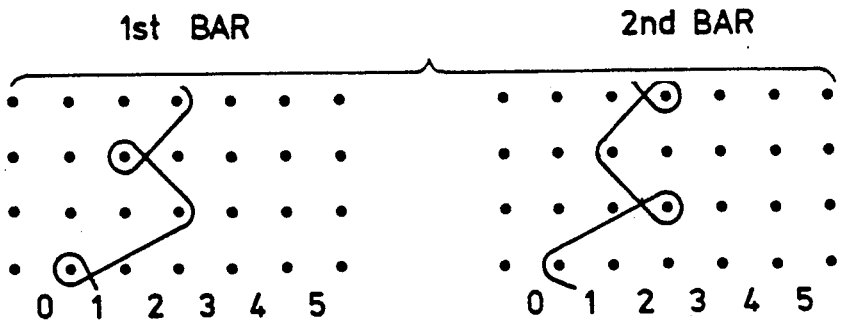
Figure 17:
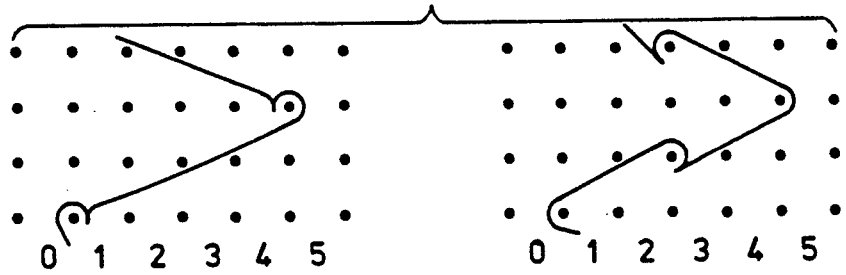
Figure 18:
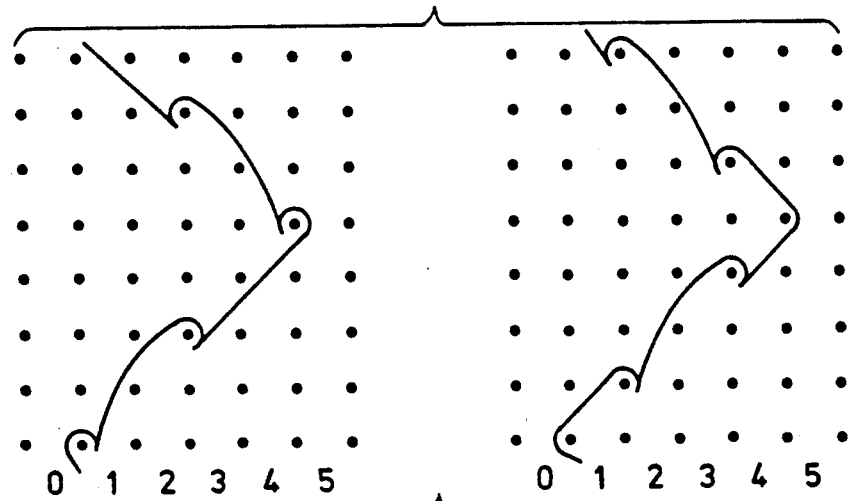
Figure 19:
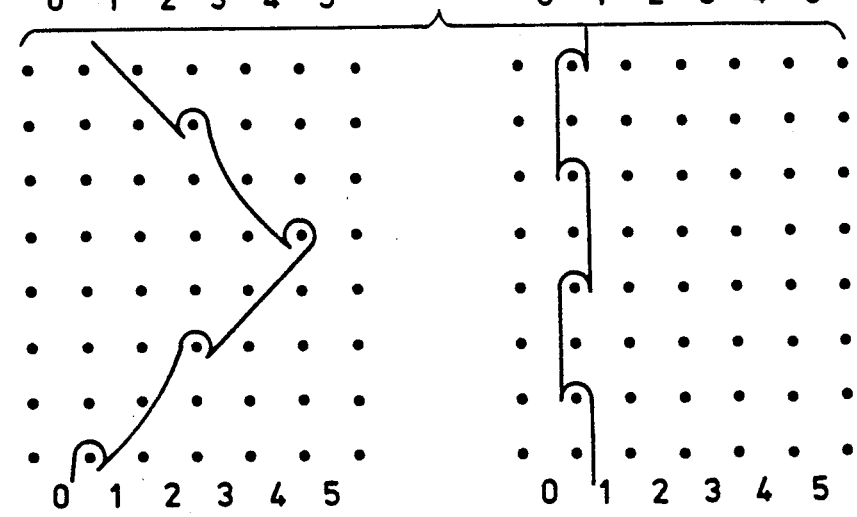
Figure 20:
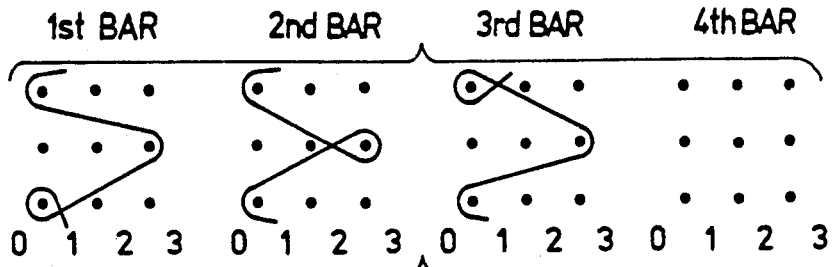
Figure 21:
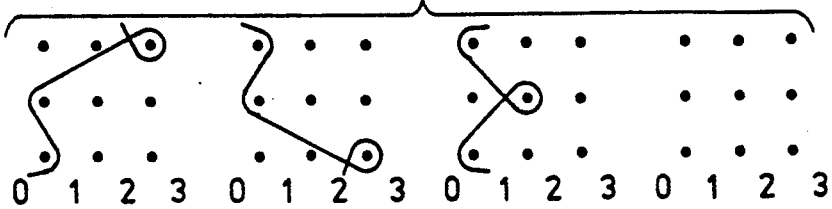
Figure 22:
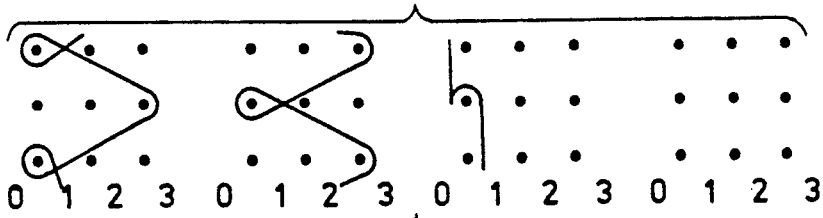
Figure 23:
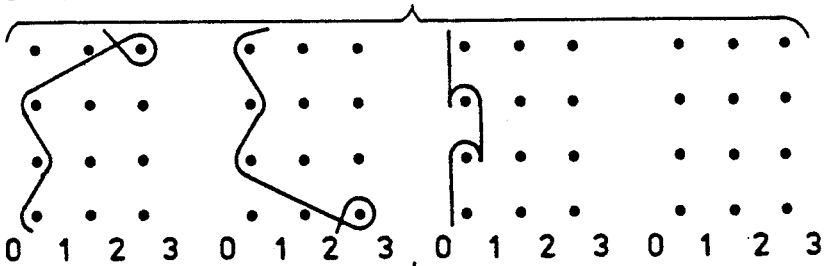
Figure 24:
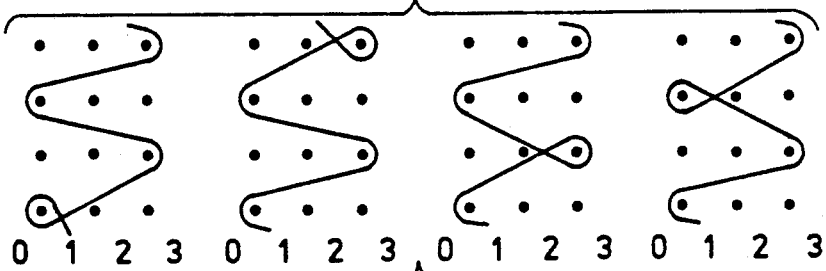
Figure 25:
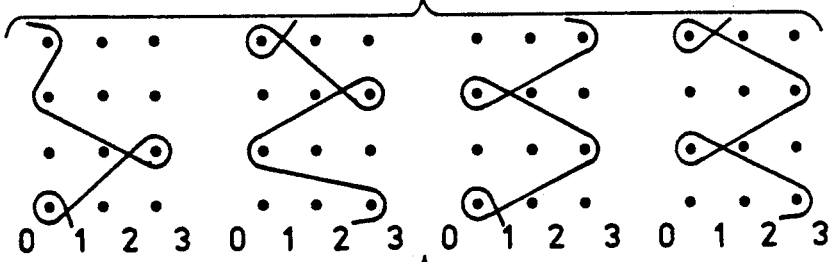
Figure 26:
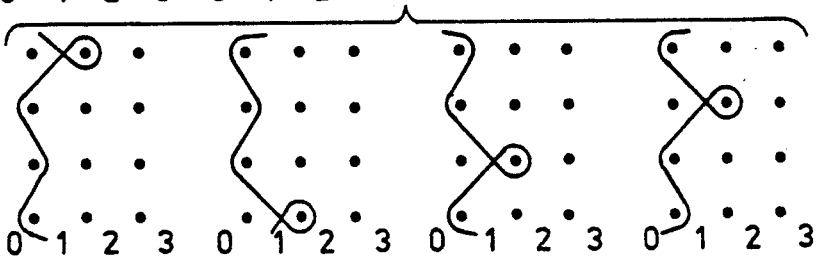
Figures 27, 28, 29, 30, 31, 32, 33, 34:
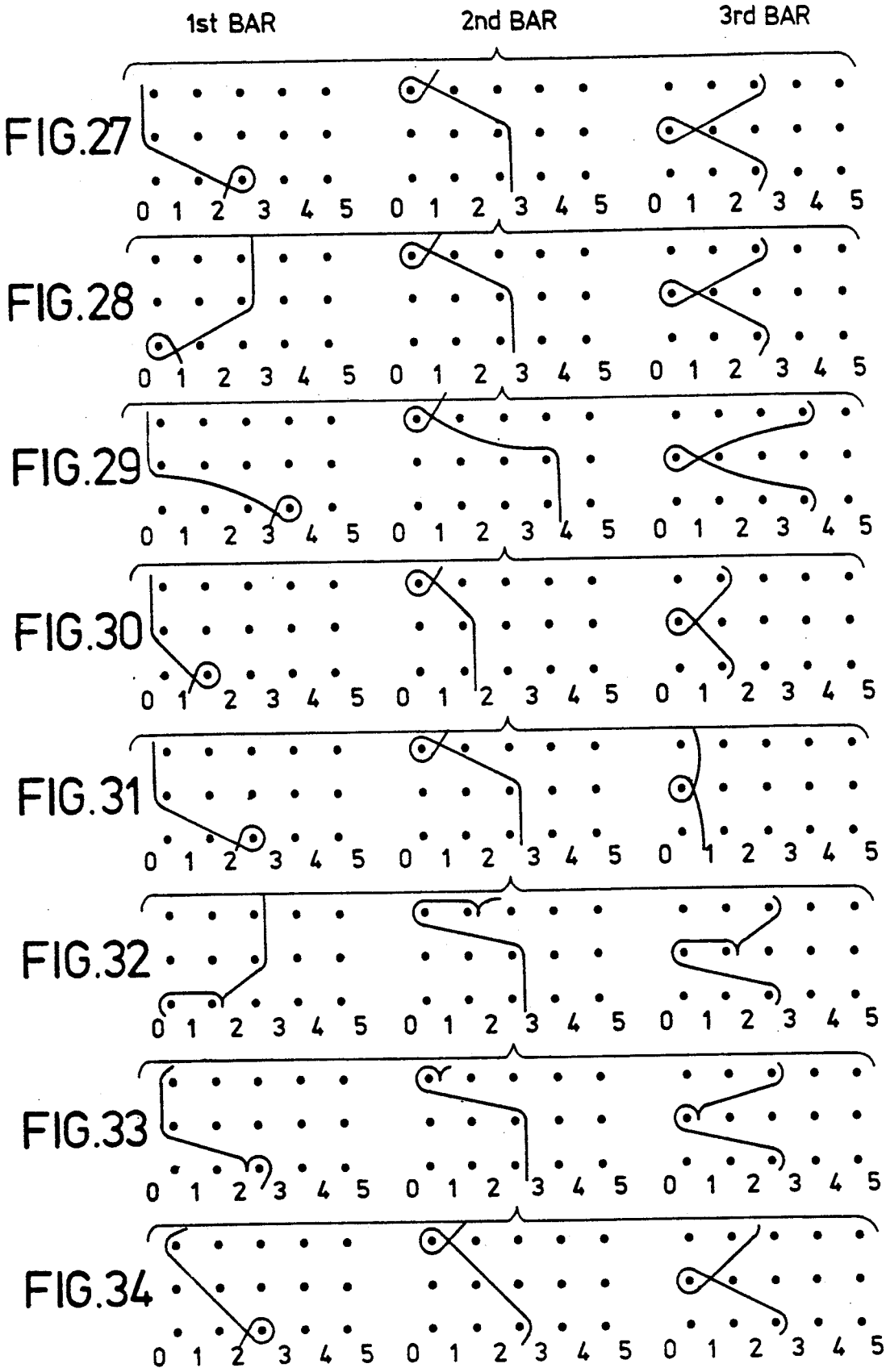
Figures 35, 36, 37, 38, 39, 40:
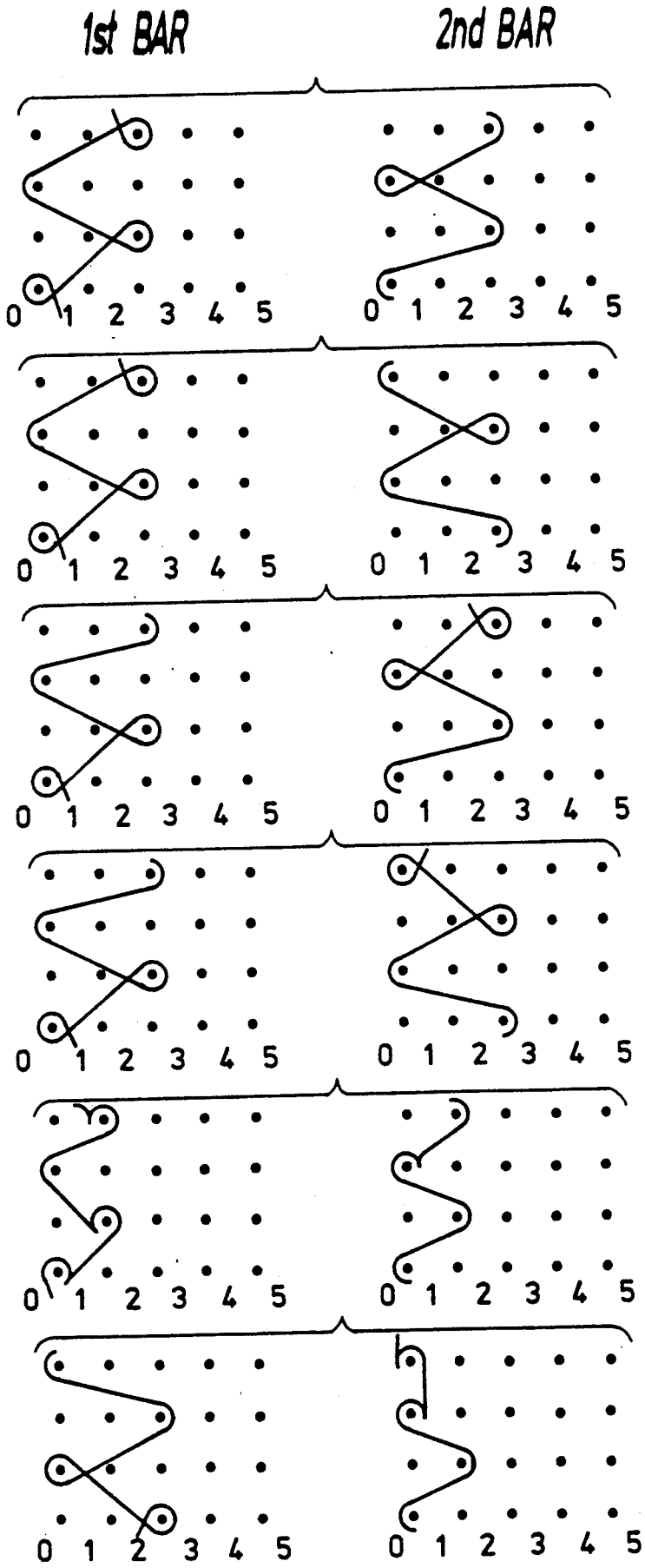

FIG. 2 represents a three course interlocking structure with three guide bars going in the same direction.

FIGS. 3 to 44 are the examples of the new structures that could be produced on warp knit equipment for example.

FIGS. 3 to 15 represent two bar, two course interlocking structures going in the same direction.

FIGS. 16 to 19 represent two bar, four and eight course interlocking structures going in the same direction, but incorporating Atlas Stitches and chain or piller stitches.

FIGS. 20 to 22 and 27 to 34 represent three bar, three and four course interlocking structures with guide bars going in the same and opposite directions.

FIGS. 23 and 24 to 26 represent four bar, four course interlocking structures with guide bars going in the same and opposite directions.

FIGS. 35 to 40 represent two bar, four course interlocking structures with guide bars going in the same and opposite directions.

Figure 41:
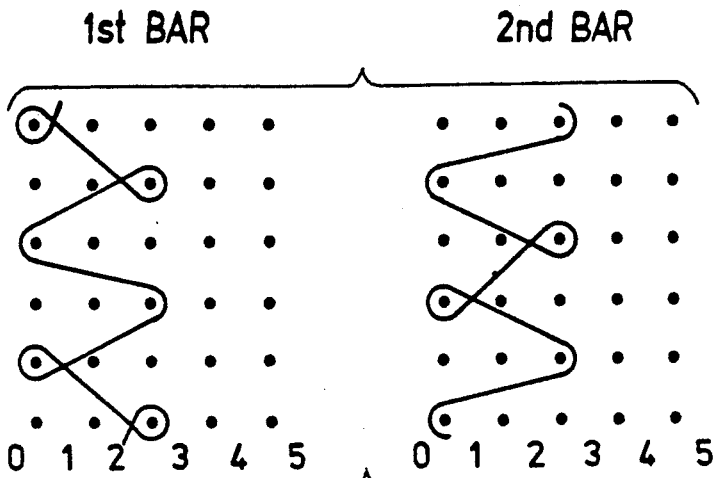
Figure 42:
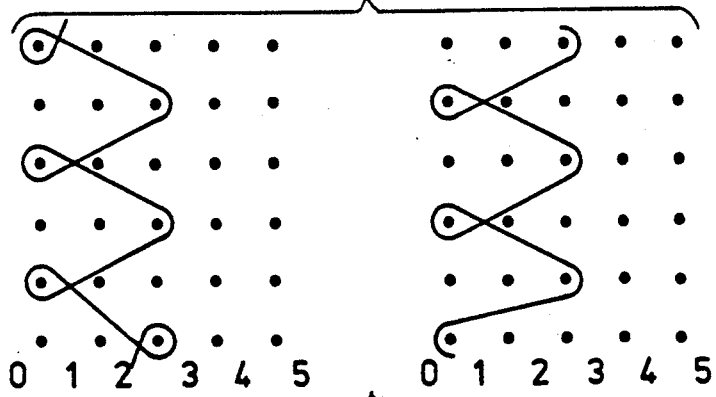
Figure 44:
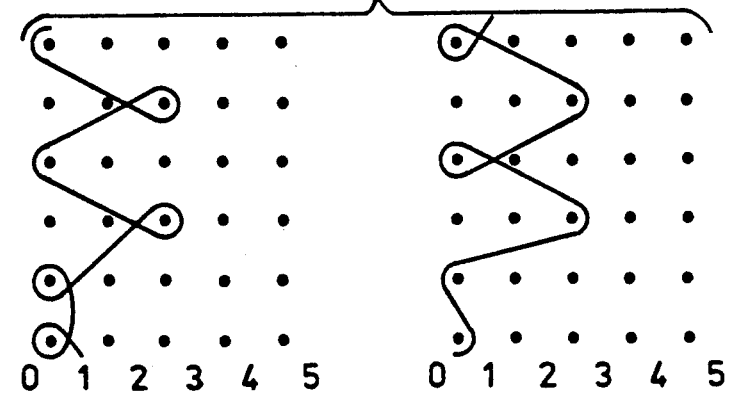

FIGS. 41, 42 and 44 represent two bar, six course interlocking structures with guide bars going in the same and opposite direction.

Figure 43:
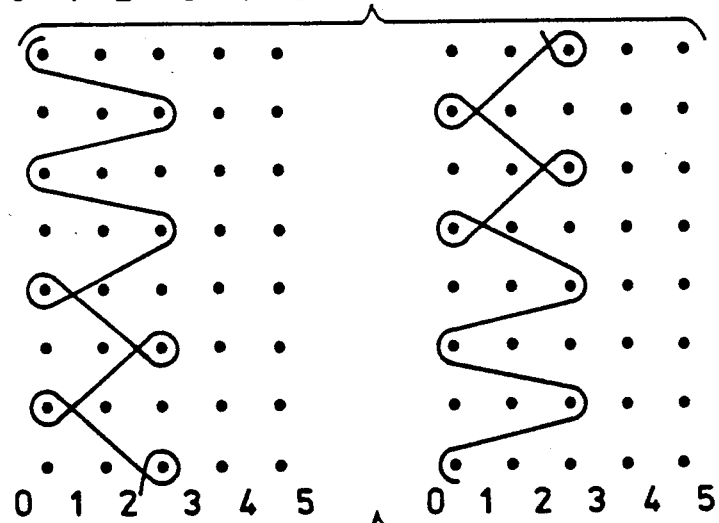

FIG. 43 represents two bar, eight course interlocking structures with guide bars going in the opposite direction.

From the above it should be understood that a warp knitter skilled in the art can knit the two, three, four, five, six, seven and eight bar and course fabrics with knit-in and laid-in stitches including close (e.g. 2-3, 1-0), open (e.g. 3-2, 0-1), mix (e.g. 2-3, 0-1) stitches and two needles (e.g. 1-0, 1-2), three needle (2-3, 1-0), four needle (3-4, 1-0) or five needle (1-0, 5-4) floats. Also, one could use chain or piller stitches (e.g. 1-0, 0-1 or 0-1, 1-0) Also one could use a variety of laid-in stitches, e.g 0, (e.g. 0-0), 1 (e.g. 0-0, 1-1), 2 (e.g. 0-0, 2-2), 3 (e.g. 0-0, 3-3), 4 (e.g. 0-0, 4-4) and 5 (e.g. 0-0, 5-5) needle floats. In addition, one could incorporate Jersey (e.g. 2-3, 1-0//1-0, 1-2), stabilized (e.g. 1-0, 0-1//2-3, 1-0), Delaware (e.g. 2-3, 1-0//1-0, 0-1), Atlas (e.g. 0-1, 1-2, 3-2, 2-1), or knit weft insertion stitch or knit-lay Brandywine stitch techniques (U.S. Pat. No. 4,688,403).

In another embodiment using three guide bars on a warp-knitting machine, a first guide is operated in a repeating stitch pattern of knit-in stitches and a second guide bar is operated in a repeating stitch pattern of alternating laid-in and knit-in stitches while the third guide bar is operated in a repeating stitch pattern opposite that in the same direction as the second guide threads stitch pattern wherein when the second guide threads are laid-in the third guide threads are knit-in and the pattern is repeated. The first guide bar threads are non-elastomeric such as nylon and the second and third guide bar threads are elastomeric such as spandex. Three fabric constructions exemplifying this embodiment are set forth in Table III.

TABLE I

| FIG. No. | Front or 1st Bar | Middle or 2nd Bar | Back or 3rd Bar |
|---|---|---|---|
| 1 | 2-3, 0—0 | 3—3, 1-0 | — |
| 2 | 2-3, 0—0, 0—0 | 0—0, 2-3, 0—0 | 0—0, 0—0, 2-3 |
| 3 | 1-0, 3—3 | 3—3, 1-0 | — |
| 4 | 2-3, 0—0 | 3—3, 1-0 | — |
| 5 | 3-4, 0—0 | 4—4, 1-0 | — |
| 6 | 3-2, 0—0 | 3—3, 1-0 | — |
| 7 | 1-2, 0—0 | 2—2, 1-0 | — |
| 8 | 2-3, 0—0 | 4—4, 1-0 | — |
| 9 | 2-3, 0—0 | 1—1, 1-0 | — |
| 10 | 2-3, 0—0 | 5—5, 1-0 | — |
| 11 | 1-3, 0—0 | 3—3, 2-0 | — |
| 12 | 4-2, 0—0 | 4—4, 0-3 | — |
| 13 | 2-3, 0—0 | 3—3, 0-2 | — |
| 14 | 2-3, 0—0 | 3—3, 0-1 | — |
| 15 | 0-1, 5—5 | 0—0, 5-4 | — |
| 16 | 1-0, 3—3, 2-1, 3—3 | 0—0, 2-3, 1—1, 2-3 | — |
| 17 | 0-1, 3—3, 5-4, 2—2 | 0—0, 2-3, 5—5, 3-2 | — |
| 18 | 0-1, 1—1, 2-3, 4—4 | 0—0, 1-2, 2—2, 3-4 | — |
| | 5-4, 4—4, 3-2, 1—1 | 5—5, 4-3, 3—3, 2-1 | |
| 19 | 0-1, 2—2, 2-3, 4—4 | 1—1, 1-0, 0—0, 0-1 | — |
| | 5-4, 3—3, 3-2, 1—1 | | |
| 20 | 1-0, 3—3, 0—0 | 0—0, 2-3, 0—0 | 0—0, 3—3, 1-0 |
| 21 | 1—1, 0—0, 2-3 | 2-3, 0—0, 1—1 | 0—0, 1-2, 0—0 |
| 22 | 1-0, 3—3, 1-0 | 3—3, 1-0, 3—3 | 1—1, 1-0, 0—0 |
| 23 | 0—0, 1—1, 0—0, 2-3, | 2-3, 0—0, 1—1, 0—0 | 0—0, 0-1, 1-0, 0—0 |

| FIG. No. | Front or 1st Bar | 2nd Bar | 3rd Bar | Back or 4th Bar |
|---|---|---|---|---|
| 24 | 1-0, 3—3, 0—0, 3—3 | 0—0, 3—3, 0—0, 2-3 | 0—0, 2-3, 0—0, 3—3 | 0—0, 3—3, 1-0, 3—3 |
| 25 | 1-0, 2-3, 0—0, 1—1 | 3—3, 0—0, 2-3, 1-0 | 1-0, 3—3, 1-0, 3—3 | 3—3, 1-0, 3—3, 1-0 |
| 26 | 0—0, 1—1, 0—0, 1-2 | 1-2, 0—0, 1—1, 0—0 | 0—0, 1-2, 0—0, 1—1 | 1—1, 0—0, 1-2, 0—0 |
| 27 | 2-3, 0—0, 0—0 | 3—3, 3—3, 1-0 | 3—3, 1-0, 3—3 | |
| 28 | 1-0, 3—3, 3—3 | 3—3, 3—3, 1-0 | 3—3, 1-0, 3—3 | |
| 29 | 3-4, 0—0, 0—0 | 4—4, 4—4, 1-0 | 4—4, 1-0, 4—4 | |
| 30 | 1-2, 0—0, 0—0 | 2—2, 2—2, 1-0 | 2—2, 1-0, 2—2 | |
| 31 | 2-3, 0—0, 0—0 | 3—3, 3—3, 1-0 | 1—1, 1-0, 1—1 | |

TABLE I-continued

| | | | |
|---|---|---|---|
| 32 | 0-2, 3—3, 3—3 | 3—3, 3—3, 0-2 | 3—3, 0-2, 3—3 |
| 33 | 3-2, 0—0, 0—0 | 3—3, 3—3, 0-1 | 3—3, 0-1, 3—3 |
| 34 | 2-3, 1—1, 0—0 | 3—3, 2—2, 1-0 | 3—3, 1-0, 2—2 |

| FIG. No. | Front or 1st Bar | Back or 2nd Bar |
|---|---|---|
| 35 | 1-0, 2-3, 0—0, 2-3 | 0—0, 3—3, 1-0, 3—3 |
| 36 | 1-0, 2-3, 0—0, 2-3 | 3—3, 0—0, 2-3, 0—0 |
| 37 | 1-0, 2-3, 0—0, 3—3 | 0—0, 3—3, 1-0, 2-3 |
| 38 | 1-0, 2-3, 0—0, 3—3 | 3—3, 0—0, 2-3, 1-0 |
| 39 | 0-1, 2-1, 0—0, 2-1 | 0—0, 3—3, 0-1, 2—2 |
| 40 | 2-3, 1-0, 3—3, 0—0 | 0—0, 2—2, 0-1, 1-0 |
| 41 | 2-3, 1-0, 3—3, 0—0, 2-3, 1-0 | 0—0, 3—3, 1-0, 2-3, 0—0, 3—3 |
| 42 | 2-3, 1-0, 3—3, 1-0, 3—3, 1-0 | 0—0, 3—3, 1-0, 3—3, 1-0, 3—3 |
| 43 | 2-3, 1-0, 2-3, 1-0, 3—3, 0—0, 3—3, 0—0 | 0—0, 3—3, 0—0, 3—3, 1-0, 2-3, 1-0, 2-3 |
| 44 | 1-0, 1-0, 2-3, 0—0, 2-3, 0—0 | 1—1, 0—0, 3—3, 1-0, 3—3, 1-0 |

EXAMPLE

A tricot warp knitting machine was employed to produce the fabrics as identified in Table II as Fabric Nos. D3, E, 30A and F.

Figure 46:
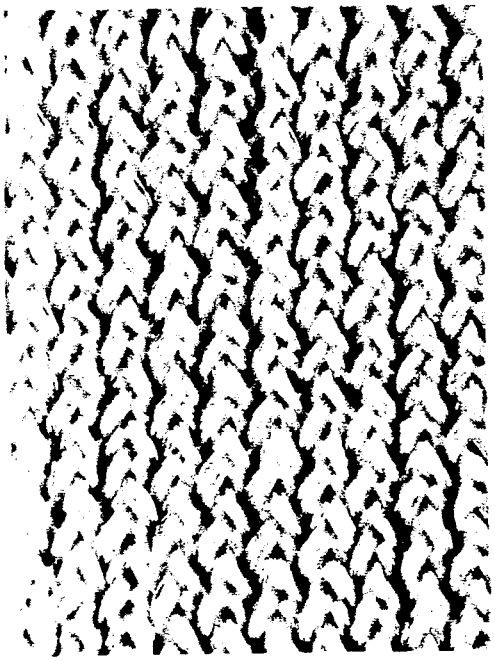
FIGS. 46 and 47 are photographs, enlarged 25 X, of the face (loop) and back (float) sides respectively of a fabric knit according to the invention (fabric F, Table II).
Figure 47:
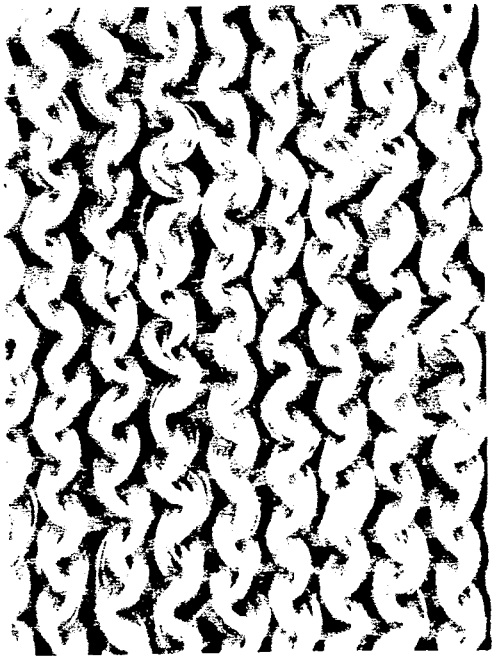
Figure 48:
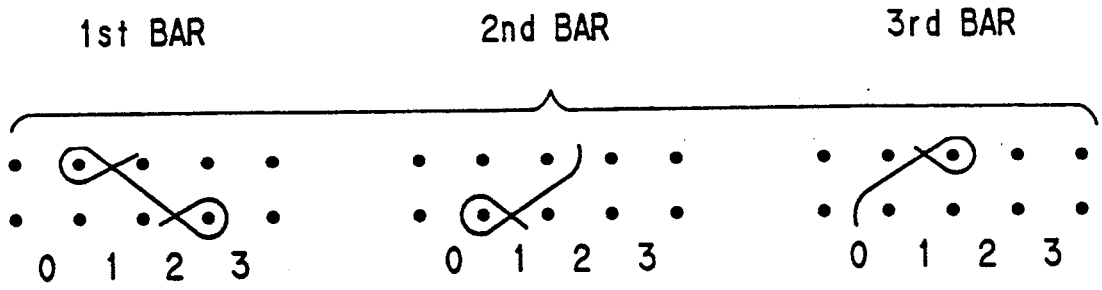

Fabrics D3, E and 30A are control fabrics. Fabric F of this invention is shown in FIGS. 1, 46 and 47.

The test method for determining thickness, bulk, static extension, air permeability and power, and finishing procedures for the fabrics are detailed below.

TEST METHODS

Thickness is measured according to ASTM D1777-64 using apparatus commercially available from Customer Scientific Instruments, Inc., Whippany, N.J. Thickness is measured in inches.

Bulk (specific volume is calculated according to the formula:

$$\text{Bulk (cm}^3\text{/g)} = \frac{2.54 \times 8361 \times T}{28.35\ H}$$

wherein T = Thickness (inches)

W-Weight (g/cm$^2$)

Hand Stretch is the percent length change of a fabric sample pulled by hand expressed as a percentage of original relaxed length.

Power is measured in general accordance with ASTM D 177581. A three (3) inch wide fabric sample is stretched at a constant rate on an Elongation Tensile Testing Machine under a load of three (3) and twelve (12) pounds. Power is the force in pounds per square inch of fabric area at fifty percent (50%) elongation on the unload cycle. In the same test percent work recovery and percent elongation were measured.

Static Extension Test determines fabric elongation and growth. Measurements are made using a Model C5138 static extension tester available from Customer Scientific Instrument Co., Kearny, N.J.

Test Stretch is the length of a fabric sample while under a load of 2 lb. per inch fabric width expressed as a percentage of original relaxed length.

Growth is measured by holding a fabric sample at 80% of the total stretch under four pound load for two hours, then measuring its relaxed length after one minute and again after one hour. Growth is expressed as percentages of original relaxed fabric length.

Air Permeability is the rate of air flow through the fabric under a differential pressure between the two fabric surfaces and expressed in cubic feet of air per minute per square foot of fabric. It is measured in accordance with ASTM Method D737-75.

FINISHING PROCEDURE

Step 1-Steam the fabrics.

Step 2-Heat set the fabrics on the Pin Tenter at 375° F. 4 boxes-50 secs. 7% overfeed and 7% over with the greige fabric.

Step 3-Beck scour and dye the fabrics.

Step 4-Dry on the Pin Tenter at 290° F. 30 yds./min. and set the Pin Tenter at the fabric's wet width.

While the invention has been illustrated using elastomeric yarns, it should be understood that a stretchable textured yarn would provide similar surface effects. This technology is also useful for two needle bed warp knit machines, e.g. "simplex" machines.

TABLE II

FABRIC CONSTRUCTIONS
NYLON/LYCRA SPANDEX TRICOT - 28 GAUGE
F.B. AND/OR MIDDLE BAR 40-13 T860 BRIGHT NYLON//
B.B. 40 DENIER LYCRA

| Fabric No. | Front Bar | Middle Bar | Back Bar | Quality Inches | Runners No. of F.B.//M.B.//B.B.* | Type Bars | Fabric |
|---|---|---|---|---|---|---|---|
| D3 | 1-0, 3—3 | 3—3, 1-0 | 1-0, 1-2 | 7½ | 37.5//37.5//27 | 3 | Control |
| E | 1-0, 3—3 | 3—3, 1-0 | 0—0, 3—3 | 6½ | 35//35//3 | 3 | Control |
| 30A# | 2-3, 1-0 | — | 1-0, 1-2 | 7½ | 58//24 | 2 | Control |
| F | 2-3, 0—0 | 3—3, 1-0 | 1-0, 1-2 | 6½ | 37//37//26 | 2 | Test |

GREIGE AND BOILED OFF FABRIC PROPERTIES
NYLON/LYCRA SPANDEX TRICOT - 28 GAUGE
F.B. AND/OR M.B. 40-13 T860 NYLON//B.B. 40 DENIER LYCRA

| | Greige Fabrics | | | | | | | Boiled Off | | |
|---|---|---|---|---|---|---|---|---|---|---|
| | | | Hand Stretch | | | | | | | |
| Fabric No. | Weight Oz./Yd.$^2$ | Count WXC/In. | % W | % C | Thick BSI | Bulk CC/G | Width Inch | Weight Oz./Yd$^2$ | Thick. BSI | Bulk CC/G |

TABLE II-continued

| | | | | | | | | | | | |
|---|---|---|---|---|---|---|---|---|---|---|---|
| D3 | 8.8 | 86 × 114 | 160 | × | 200 | .053" | 4.50 | 28¼ | 10.8 | .052 | 3.60 |
| E | 5.1 | 72 × 112 | 20 | × | 220 | .036" | 5.34 | 22 | 6.1 | .036 | 4.44 |
| 30A | 6.3 | 68 × 116 | 160 | × | 160 | .038" | 4.52 | 33 | 8.4 | .038 | 3.39 |
| F | 9.6 | 92 × 100 | 160 | × | 220 | .056" | 4.39 | 26 | 11.7 | .053 | 3.38 |

FINISHED FABRIC PROPERTIES
NYLON/LYCRA SPANDEX TRICOT - 28 GAUGE
F.B. AND/OR M.B. 40-13 T860 BRIGHT NYLON//B.B. 40 DENIER LYCRA

| Fabric | Weight | | Count | | | Thick | Bulk | Hand Stretch | | |
|---|---|---|---|---|---|---|---|---|---|---|
| No. | Oz./Yd.$^2$ | Width | WPI | | CPI | BSI | CC/G | % Wale | | % Course |
| D3 | 7.8 | 30 | 82 | × | 96 | .047" | 4.54 | 120 | × | 180 |
| E | 3.6 | 24 | 88 | × | 42 | .017" | 3.56 | 0 | × | 180 |
| 30A | 5.4 | 35 | 64 | × | 116 | .033" | 4.41 | 130 | × | 130 |
| F | 7.9 | 31 | 78 | × | 42 | .047" | 4.46 | 120 | × | 180 |

| | Woven Static Ext. Test (3321-03) | | | | | | | |
|---|---|---|---|---|---|---|---|---|
| Fabric | % Avail. Fab. Str. | | % Test Eng. | | % Growth 1 Min. | | % Growth 1 Hr. | |
| No. | Wale | Course | Wale | Course | Wale | Course | Wale | Course |
| D3 | 193 | 239 | 154 | 191 | 23 | 17 | 17 | 8 |
| E | 16 | 308 | 13 | 246 | 4 | 3 | 3 | 21 |
| 30A | 202 | 142 | 166 | 113 | 28 | 14 | 18 | 5 |
| F | 222 | 209 | 177 | 167 | 38 | 6 | 24 | 1 |

| Fabric | Cu. Ft. | Wet Sag % Rec. | | Zwick | |
|---|---|---|---|---|---|
| No. | Min./Ft.$^2$ | Wale | Course | 3 lb. Wale | 12 lb. Wale |
| D3 | 163 | 61 | 34 | 0 | 0 |
| E | 253 | 52 | 46 | 0 | 0 |
| 30A | 258 | 52 | 34 | 0 | 0 |
| F | 217 | 60 | 36 | 0 | 0 |

| Fabric | Unload - 50% | | % Work Rec. | | % Elongation | |
|---|---|---|---|---|---|---|
| No. | Wale | Course | Wale | Course | Wale | Course |
| D3 | .155 | .091 | 52 | 50 | 193 | 210 |
| E | 0 | .008 | 0 | 43 | 0 | 303 |
| 30A | .083 | .105 | 60 | 61 | 197 | 140 |
| F | .171 | .090 | 53 | 57 | 155 | 178 |

*All guide bars are fully threaded
#Jersey Control

TABLE III

FABRIC CONSTRUCTION FRONT BAR 40-13 NYLON AND MIDDLE AND BACK BARS 40 DENIER T146 LYCRA BY DU PONT

| | Stitch | | | Runners | | | |
|---|---|---|---|---|---|---|---|
| Fabric No. | F.B./M.B./B.B. | Quality | Gauge | F.B. | M.B. | B.B. | % Lycra |
| 92A | 2-3, 1-0/1-0, 2—2/ 0—0, 1-2 | 7½" | 28 | 60" | 28" | 28" | 36.2 |
| 92B | 2-3, 1-0/1-0, 2—2/ 2—2, 1-0 | 7½" | 28 | 60" | 28" | 20" | 33.3 |
| 92D | 3-4, 1-0/1-0, 2—2/ 0—0, 1-2 | 7½" | 28 | 89" | 20" | 20" | 20.3 |

While single needle bar machines have been disclosed for knitting the fabrics of this invention, it should be understood that these fabrics can be knit with two needle bar machines. In addition, a fabric could be knit of 100% elastomeric yarn or with non-elastomeric in the front bar and elastomeric yarns in the middle and back bars which would provide middle and back bar interlocking.

I claim:

1. A method of warp knitting a plurality of threads from three guide bars on a warp knitting machine operating in a multi-course repeating stitch pattern which comprises the steps of: operating first guide threads in a repeating stitch pattern of knit-in stitches, and operating the second guide threads in a repeating stitch pattern of alternating laid-in and knit-in stitches, while operating third guide threads in a repeating stitch pattern that is in the same direction to said second guide threads stitch pattern wherein when said second guide threads are laid-in, said third guide threads are knit-in and subsequently repeating both stitch patterns.

2. A fabric knit according to claim 1 wherein the first guide bar yarn is non-elastomeric and the second and third guide bar yarn is elastomeric yarn.

3. A method of warp knitting a plurality of threads from three guide bars on a warp knitting machine operating in a multi-course repeating stitch pattern comprising: operating said guide bars so that the threads of each guide bar knit in only one course within a repeating stitch pattern while those guide bar threads not knitting are laid-in and subsequently repeating said stitch pattern.

4. A method of warp knitting a plurality of threads from four guide bars on a warp knitting machine operating in a multi-course repeating stitch pattern comprising: operating said guide bars so that the threads of each guide bar knit in only one course within a repeating stitch pattern while those guide bar threads not knitting are laid-in and subsequently repeating said stitch pattern.

* * * * *